US010172398B2

(12) United States Patent
Saco

(10) Patent No.: US 10,172,398 B2
(45) Date of Patent: Jan. 8, 2019

(54) HEADWEAR WITH INTEGRATED SANITARY SHIELD

(71) Applicant: Frank Saco, Walled Lake, MI (US)

(72) Inventor: Frank Saco, Walled Lake, MI (US)

( * ) Notice: Subject to any disclaimer, the term of this patent is extended or adjusted under 35 U.S.C. 154(b) by 382 days.

(21) Appl. No.: 14/656,262

(22) Filed: Mar. 12, 2015

(65) Prior Publication Data

US 2015/0182765 A1 Jul. 2, 2015

Related U.S. Application Data

(63) Continuation-in-part of application No. 14/120,843, filed on Jul. 2, 2014, now abandoned, which is a continuation-in-part of application No. 12/707,557, filed on Feb. 17, 2010, now abandoned.

(51) Int. Cl.
*A41D 13/11* (2006.01)

(52) U.S. Cl.
CPC ..... *A41D 13/1161* (2013.01)

(58) Field of Classification Search
CPC ..... H04R 1/08; H04R 1/083; H04R 1/068; A61F 9/02–9/068; A41D 13/11–13/12; A45D 44/12; A62B 18/00; A62B 18/02; A62B 18/025; A62B 18/084; A62B 23/00; A62B 23/02; A62B 23/025; A62B 18/003; A42B 3/18; A42B 3/20; A42B 3/28; A42B 3/288
USPC ..... 128/863
See application file for complete search history.

(56) References Cited

U.S. PATENT DOCUMENTS

| | | | | | |
|---|---|---|---|---|---|
| 1,485,160 | A | | 2/1924 | Bassan | |
| 1,561,760 | A | | 11/1925 | Whelan | |
| 1,671,342 | A | | 5/1928 | Cantor | |
| 2,281,181 | A | | 4/1942 | Clarke | |
| 3,040,741 | A | * | 6/1962 | Carolan | A62B 18/084 128/206.27 |
| 3,119,904 | A | * | 1/1964 | Anson | H04M 1/05 15/244.1 |
| 3,152,588 | A | * | 10/1964 | Rogowski | A41D 13/11 128/206.12 |
| 3,740,768 | A | | 6/1973 | McCosker | |

(Continued)

*Primary Examiner* — Victoria J Hicks
*Assistant Examiner* — Michelle Lee
(74) *Attorney, Agent, or Firm* — Dinsmore & Shohl, LLP

(57) ABSTRACT

A sanitary mouth shield assembly including a headset with multiple locations of adjustability, both linear and rotational, in order to accommodate a variety of head sizes. A pair of side portions support therebetween a bridging and arcuate extending, length adjustable band. A shield sub-assembly is supported by the headset and includes elongated and arcuate side supports which are rotatably and adjustably secured at first ends to exterior side locations of the side supports. The shield sub-assembly is rotatably supported to extending ends of the sides supports and in turn exhibits a combination arcuate and planar shape. A base component of the shield subassembly includes a pair of end supported clips. A fibrous filter element is sandwiched between an inner surface of the base component and an attachable retaining component, the retaining component including lateral projections which seat within the clips to secure the subassembly in place. The inside bottom and proximate side edges of the base component further exhibit a fluid retaining trough.

7 Claims, 3 Drawing Sheets

(56) References Cited

U.S. PATENT DOCUMENTS

| | | | |
|---|---|---|---|
| 3,772,707 | A | 11/1973 | Alosi et al. |
| 3,908,648 | A | 9/1975 | McCosker |
| 3,918,448 | A | 11/1975 | McCosker |
| 3,991,753 | A | 11/1976 | Viesca y Viesca |
| 4,039,765 | A | 8/1977 | Tichy et al. |
| 4,042,974 | A | 8/1977 | Morgan et al. |
| 4,944,039 | A | 7/1990 | Dietrich |
| 5,504,943 | A | 4/1996 | Han |
| D380,477 | S | 7/1997 | Williams et al. |
| 6,560,335 | B2 | 5/2003 | Zohn et al. |
| 2002/0131616 | A1 | 9/2002 | Bronnikov et al. |
| 2002/0148028 | A1 | 10/2002 | Bush |
| 2003/0000001 | A1 | 1/2003 | McDonald et al. |
| 2003/0136408 | A1 | 7/2003 | Henley |
| 2004/0006804 | A1 | 1/2004 | Bush |
| 2005/0086725 | A1 | 4/2005 | Kameya |
| 2007/0083967 | A1 | 4/2007 | Crossman et al. |
| 2008/0089546 | A1 | 4/2008 | Ward |
| 2008/0134402 | A1 | 6/2008 | Bailey |
| 2008/0304690 | A1 | 12/2008 | Poindexter |
| 2009/0126064 | A1 | 5/2009 | Reaux |
| 2010/0034412 | A1 | 2/2010 | Parda |

* cited by examiner

HEADWEAR WITH INTEGRATED SANITARY SHIELD

CROSS-REFERENCE TO RELATED APPLICATIONS

This Application is a Continuation-in-part of application Ser. No. 14/120,843 filed on Jul. 2, 2014. Application Ser. No. 14/120,843 is a Continuation-in-part of application Ser. No. 12/707,557 filed on Feb. 17, 2010, the contents of which are incorporated herein in their entirety.

FIELD OF THE INVENTION

The present invention relates to sanitary head wear and more particularly, to sanitary headwear used in the food services industry.

BACKGROUND OF THE INVENTION

Restaurants and other food service business prepare and serve meals to paying customers. During this preparation and tableside service numerous employees must come into close contact with the food and customers. In recent years, there has been an increased awareness and concern for preventing contamination or infection of the customers and their food through direct transmission of contagions from the food service personnel.

These contagions typically take the form of airborne pathogens, infectious aerosols, and/or particulate matter. Potentially infectious aerosols having airborne liquid and, at times, solid particles can be created through exhalation and/or talking.

Medical personnel typically wear disposable face masks which envelope and are tied around the nose and mouth of the wearer and/or full face shields to prevent contamination of their patient (and potentially the wearer). These masks and face shields, however, are not practical for food service personnel as they typically muffle the wearer's voice. In a medical setting, the muffling effect is negated due to the relative quiet of the surroundings and any important communication can be exclaimed loudly.

In addition, to muffed sounds the wearer face can become hot and uncomfortable due to exhaling warm air and the moisture that builds up in the mask. In a restaurant, uncontrolled background noise in present and customers are not expecting to be loudly spoken-to by the wait staff. Additionally, while relatively inexpensive in relation to their benefits in a medical setting, continually replacing face masks would likely be cost prohibitive for a food service setting when their use would be as much to assure the customer that their well-being is important to the restaurateur as it is as an actual prophylactic against pathogens. Similarly, while full face shields are typically reusable, their outward appearance and the overly sterile impression created by such an intrusive barrier between the restaurant employees and the customers would likely be off-putting to the customers.

The prior art includes examples of mouth covering devices. A first of these is set forth in Poindexter, US 2008/0304690, which teaches a mouth shield for a microphone headset having a rigid arcuate frame removably attachable to the mouthpiece holder of a microphone headset by a clasping means. The shield includes air vent apertures. An optional removable foam insert may be adhesively attached to an inner side of the shield to catch saliva while speaking. The shield precludes external visibility of lips while speaking and interference with audibility caused by wind and other adverse weather conditions.

A sports apparatus for covering a user's mouth is depicted in US 2008/0134402 to Bailey, which teaches a shield member. A securing device is attached at a first end thereof to a back side of the shield member at a predetermined location thereon. A second predetermined end of the securing means is removably securable to a boom microphone arm extending from a user's audio headset communication apparatus to a space in front of a mouth of such user such that when the shield member is secured to such boom microphone arm such user's mouth will be entirely hidden by the shield member.

Ward, US 2008/0089546, teaches a microphone shield plate, a shield plate arm connected at a first end therefor to the microphone shield plate, and a means for attaching a second end of the shield plate arm to a microphone headset in a manner which at least partially obscures an ability to view the headset user's mouth while speaking into the headset.

Parda, US 2010/0034412, teaches a lip shield or block that is attachable to a microphone and is sized to block or shield the lips of the user from being viewed by third parties when speaking into the microphone. Additional examples of attachable headgear, such as used with a ball cap, include each of the combination hat and headset device of Bronnikov 2002/0131616 and the headgear with attachable whistle shown in U.S. Pat. No. 5,504,943, to Han.

The teachings of the prior art aside, there remains a need for a device that will provide both a degree of protection from transmission of disease from the food service personnel to customers through airborne pathogens, while remaining unobtrusive both visually and in relation to verbal communication. Preferably such a device would be reusable to reduce the cost.

SUMMARY OF THE INVENTION

The present invention provides a sanitary mouth shield assembly including a headset having a thin and comfortable wearing construction, with multiple locations of adjustability, both linear and rotational, in order to accommodate a variety of head sizes. The headset includes a pair of side supported portions, such as approximating the wearer's temple locations, and between which bridges an arcuate extending and length adjustable band.

A shield sub-assembly is supported by the headset and includes elongated and arcuate side supports which are rotatably and adjustably secured at first ends to exterior side locations of the wearer's head approximating the temple support portions. The shield sub-assembly assembly is rotatably supported in turn to extending ends of the sides supports and in turn exhibits a combination arcuate and planar shape.

A base component of the shield subassembly includes a pair of end supported clips. A fibrous filter element is sandwiched between an inner surface of the base component and an attachable retaining component, the retaining component including lateral projections which seat within the clips to secure the subassembly in place. The inside bottom and proximate side edges of the base component further exhibit a fluid retaining trough.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

With reference to FIGS. 1-4, the present invention discloses a combination headset and sanitary mouth shield, generally at 10, according to an embodiment of the present invention. As will be described, the sanitary shield provides close conforming and adjustable support to the wearer's mouth. In the particular instance of food service workers, use of the combination shield and headset provides close conforming support of the shield over the wearer's mouth in order to optimize sanitary conditions.

Figure 1:
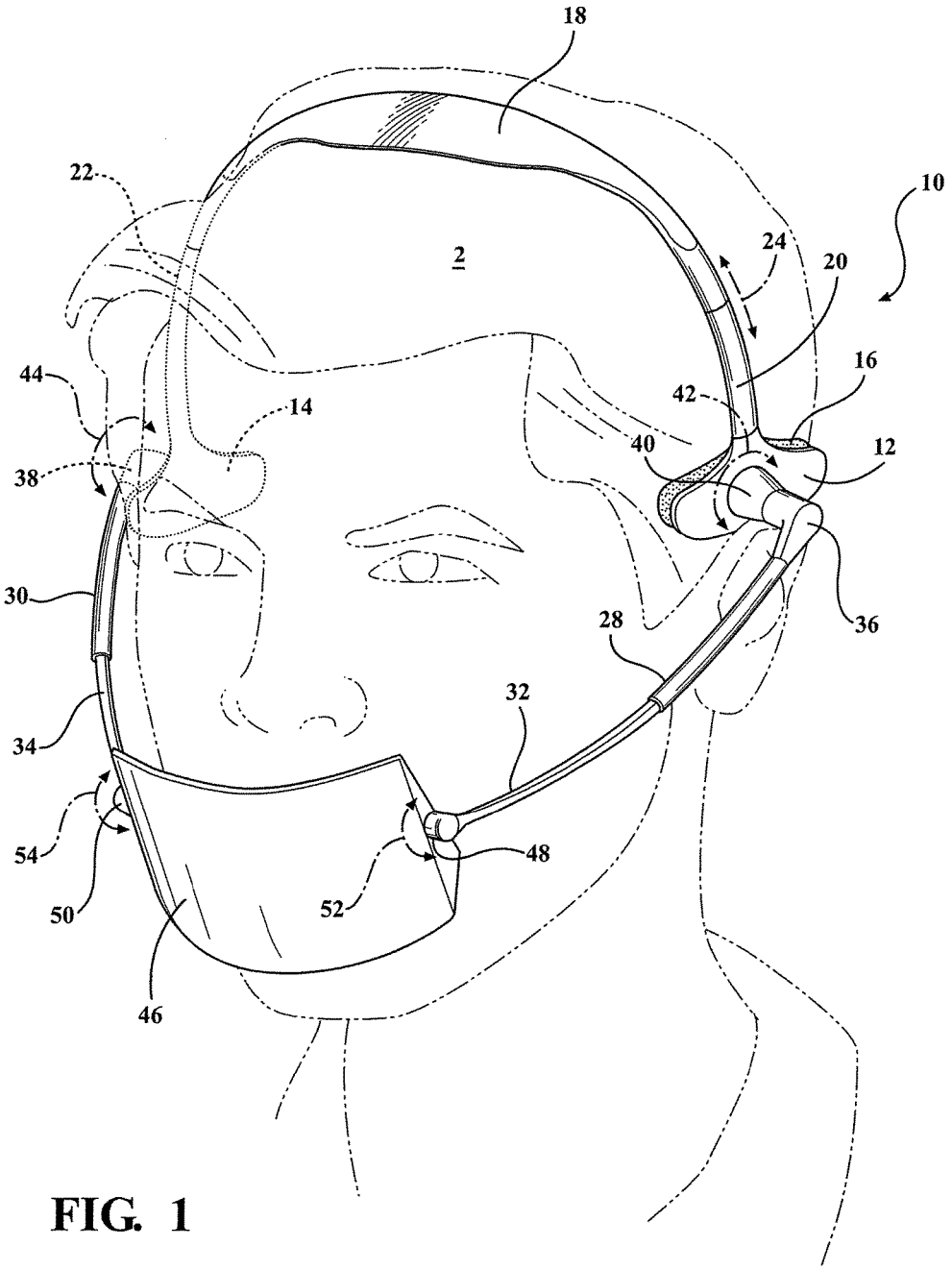
FIG. 1 is an environmental view of the headwear with integrated sanitary shield according to a preferred embodiment.
Figure 2:
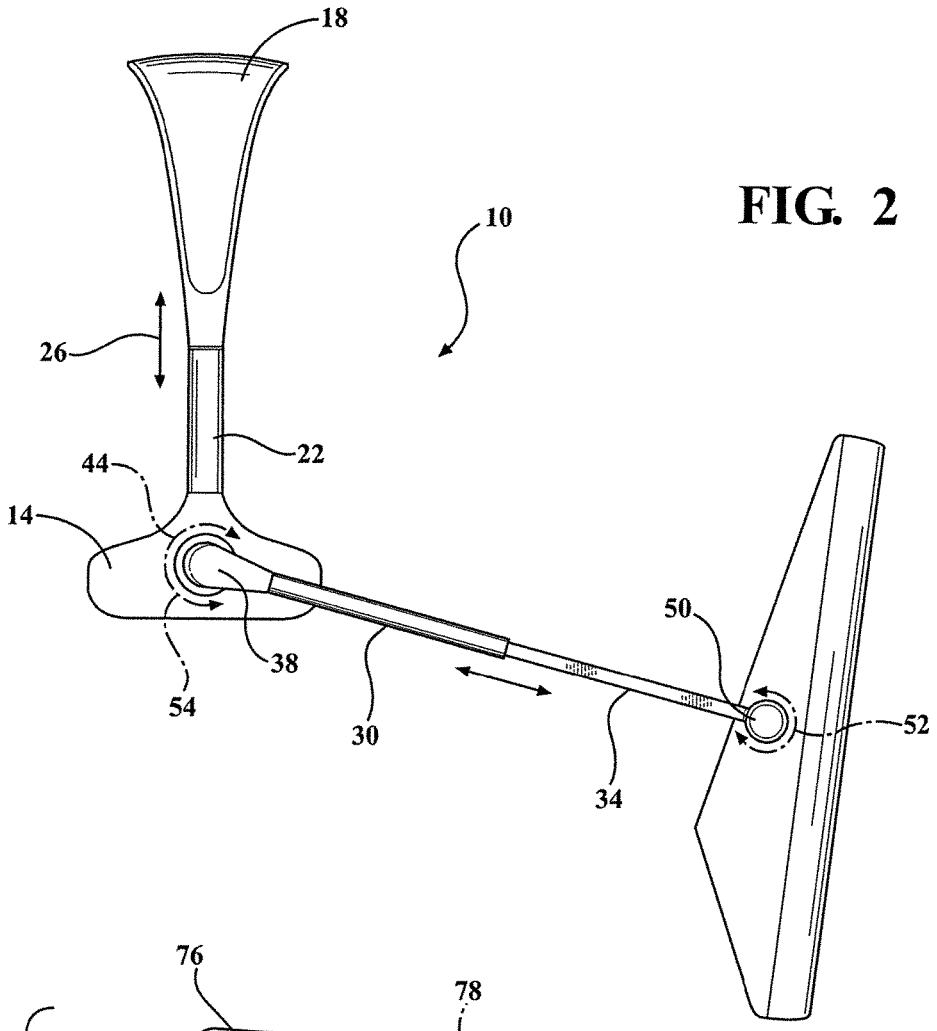
FIG. 2 is a side plan view of FIG. 1 and illustrating the multiple areas of adjustability of the combination headwear and shield.
Figure 3:
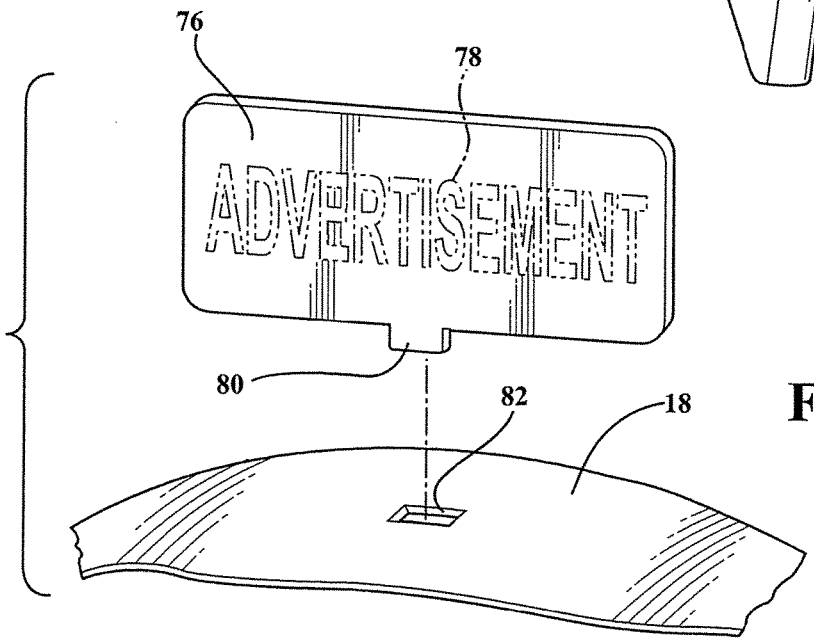
FIG. 3 is an exploded view of an optional signage attachment feature associated with the present invention.
Figure 4:
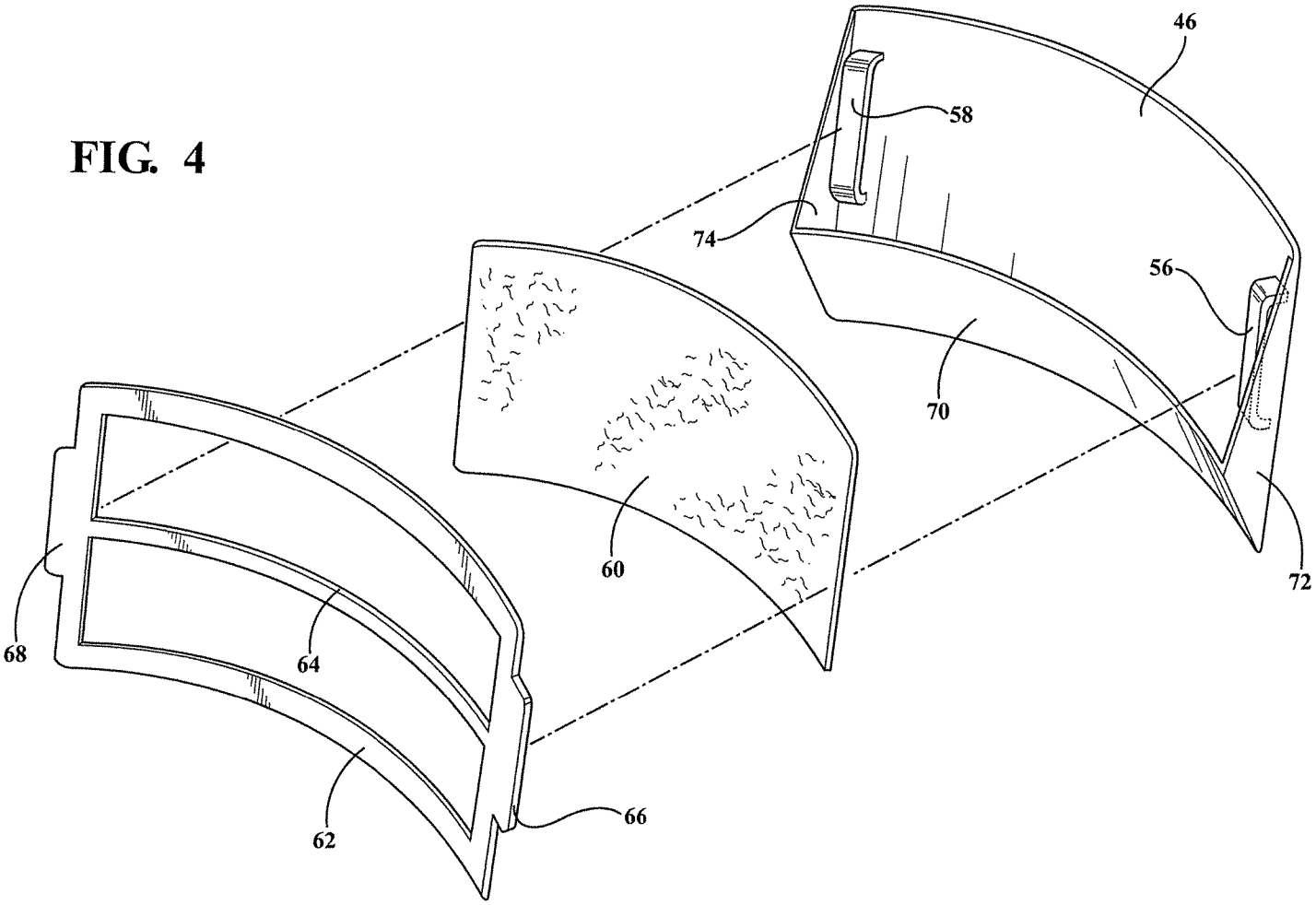
FIG. 4 is a further exploded view of the sanitary shield subassembly according to the present invention.

Referring again to FIG. 1, in combination with succeeding FIGS. 2-4, the headset includes a pair of side supported portions, see at 12 and 14, each of which further including an elongated shape with an inside surface supported cushioning portion (further at 16 for selected side portion 12). An arcuate and elongated band extends over a wearer's head 2, the band including a central and top-most extending portion 18 and a pair of opposite side extending portions 20 and 22 which are length adjustable relative to the central portion 18.

Although not shown, it is understood that the side portions 20 and 22 may each include inner stems which project into hollow communicating interior locations of the central elongated portion 18 in order to achieve different adjusted lengths (see as further referenced by linear adjustment arrows 24 and 26 in FIGS. 1 and 2). The material construction of the headset is further such that the band provides an inward bias or flex in order to retain the same upon the wearer's head. This can include, without limitation, constructing the headset and associated mouth shield assembly of either a lightweight and flexible/resilient metal or a plastic exhibiting similar characteristics.

A pair of elongated side members are provided, each exhibiting an arcuate construction and including outer 28/30 and inner 32/34 coaxially adjustable portions. Inner mounting ends of each side member includes first rotatably mounted portions 36 and 38, these engaging additional fixed pedestal supported side locations (see at 40 for selected side supported portion 12) and so that the elongated side members can be additionally rotatably adjusted as reflected by arcuate bi-directional arrows 42 and 44. As with the headset, the elongated side supports can be constructed of any suitable resilient and flexible material including lightweight metal or plastic.

A sanitary mouth shield assembly including a headset having a thin and comfortable wearing construction, with multiple locations of adjustability, both linear and rotational, in order to accommodate a variety of head sizes. The headset includes a pair of side supported portions, such as approximating the wearer's temple locations, and between which bridges an arcuate extending and length adjustable band.

A shield sub-assembly is supported by the headset and includes a combination arcuate and planar base 46. Extending ends of the elongated and arcuate side supports (see inner coax portions 32 and 34) are rotatably secured to coaxially disposed outer side locations 48 and 50 of the planar base 46 (see further bidirectional rotation arrows 52 and 54).

As best shown in FIG. 4, the base component 46 of the shield subassembly includes a pair of clips 56 and 58 located on an inside face proximate its sides. A fibrous filter element 60 is sandwiched between an inner surface of the base component 46 and an attachable retaining component, see as further shown at 62. The retaining component exhibits an outer frame and inner crosswise extending and reinforcing web or beam 64. The retaining component including lateral projections 66 and 68 which biasingly seat within the clips 56 and 58 to secure the subassembly in place.

The inside bottom and proximate side edges of the base component 46 further exhibits a fluid retaining trough and which is depicted in FIG. 4 by a depth extending and angled bottom edge 70 and interconnected side to bottom edges 72/74, these collectively defining a reservoir of suitable dimension for capturing and retaining inadvertent spittle and the like resulting from the wearer.

Finally, and referring to FIG. 3, a message board 76 is provided, such including a script or other written indicia, see at 78, and which is attachable to a central top location of the arcuate band portion 18. As further shown, a protrusion, see generally rectangular shaped as shown at 80, projects from the underside of the message board 76 which is resistively fitted into a closed perimeter surface 82 of the same shape defining a generally rectangular recess or aperture in the central portion 18. The indicia presented on the message board can provide any desired identifying or information content not limited to food information or the like.

Having described my invention, other and additional preferred embodiments will become apparent to those skilled in the art to which it pertains, and without deviating from the scope of the appended claims.

I claim:

1. A combination headset and sanitary mouth shield assembly, comprising: a headset including a pair of side support portions which are adapted to contacting side locations of a wearer's head, an arcuate extending, biasing and length adjustable band adapted to extending atop the wearer's head and between said side support portions; a mouth shield sub-assembly supported in each of rotational and length adjustable extending fashion from the headset via a pair of elongated and length adjustable members projecting from said side supported portions, said shield sub-assembly exhibiting a combination arcuate and planar shape adapted to closely overlaying the wearer's mouth; said shield sub-assembly further comprising: a solid and non-apertured base rotatably securing between extending ends of said elongated and length adjustable members, said base having a forward planar surface and an opposite inside surface, said base having a pair of sides and an interconnecting and upwardly angled bottom extending from said inner surface to define a volume retaining trough; a pair of U shaped clips extending from said inside surface proximate opposite sides of said base; a fibrous filter element sandwiched between the inside surface of the base between said clips so that said base forms an enclosure about said filter element; and an attachable retaining component, said retaining component having an outer frame including lateral projections which seat within said clips to secure said filter element in place, said retaining component having an inner crosswise extending beam for providing additional retaining support to said filter element.

2. The assembly as described in claim 1, a message board attachable to a central top location of said arcuate band.

3. The assembly described in claim 1, said headset and shield sub-assembly each having a shape and size and being constructed of a flexible and resilient lightweight material not limited to a metal or plastic.

4. The assembly as described in claim 1, said side supported portions each further comprising an elongated shape with an inner surface supported cushioning portion.

5. The assembly as described in claim 1, said band including a central and top-most extending portion, a pair of opposite side extending portions extending in length adjustable fashion relative to said central portion.

6. The assembly as described in claim 1, the sides each having a triangular shape.

7. The assembly as described in claim 1, said lateral projections having a rectangular shape.

* * * * *